US007014268B2

(12) United States Patent
Socha, Jr. et al.

(10) Patent No.: US 7,014,268 B2
(45) Date of Patent: Mar. 21, 2006

(54) NESTING CHAIR WITH FLEXIBLE BACK

(75) Inventors: David J. Socha, Jr., Toledo, OH (US); William F. Lohness, Jonesville, MI (US); R. Duane Ware, Temperance, MI (US)

(73) Assignee: Michigan Tube Swagers & Fabricators, Inc., Temperance, MI (US)

( * ) Notice: Subject to any disclaimer, the term of this patent is extended or adjusted under 35 U.S.C. 154(b) by 0 days.

(21) Appl. No.: 10/702,418

(22) Filed: Nov. 6, 2003

(65) Prior Publication Data

US 2005/0099045 A1 May 12, 2005

(51) Int. Cl.
*A47C 3/04* (2006.01)

(52) U.S. Cl. ..... 297/448.1; 297/449.1; 297/239

(58) Field of Classification Search ..... 297/445.1, 297/448.1, 449.1, 448.2, 451.1, 239; 248/440, 248/440.1
See application file for complete search history.

(56) References Cited

U.S. PATENT DOCUMENTS 2,134,639 A * 10/1938 McGowen ..... 248/440.1
D161,177 S * 12/1950 Harrison ..... D6/334
2,539,919 A * 1/1951 Meek, Jr. et al. ..... 297/448.1
2,558,022 A * 6/1951 Wallance ..... 297/452.11
2,640,527 A * 6/1953 Kreizelman ..... 297/448.1
2,806,515 A * 9/1957 Burst ..... 297/451.1
2,961,037 A * 11/1960 Keefer ..... 297/440.15
3,057,661 A * 10/1962 Moxley ..... 297/451.1
3,159,428 A * 12/1964 Schier ..... 297/452.65
3,246,928 A * 4/1966 Haynes et al. ..... 297/239
3,708,202 A * 1/1973 Barecki et al. ..... 297/239
3,724,897 A * 4/1973 Faiks et al. ..... 297/447.3
D395,181 S 6/1998 Infanti
D413,743 S 9/1999 Regan et al.

* cited by examiner

*Primary Examiner*—Peter M. Cuomo
*Assistant Examiner*—Joe Edell
(74) *Attorney, Agent, or Firm*—Gifford, Krass, Groh, Sprinkle, Anderson & Groh, P.C.

(57) ABSTRACT

A nesting chair includes a self-supporting base with a pair of leg members. Each leg member has a front leg portion, a rear leg portion, and a generally horizontal portion. A transverse member extends between and interconnects the horizontal portions of the leg members. The transverse member and the first and second leg members together define a self-supporting base. A seat cushion is supported in a generally horizontal position by the seat base. A generally L-shaped back support bracket has one end connected to the transverse member of the base and a second end connected to a seat back.

29 Claims, 4 Drawing Sheets

FIG - 5
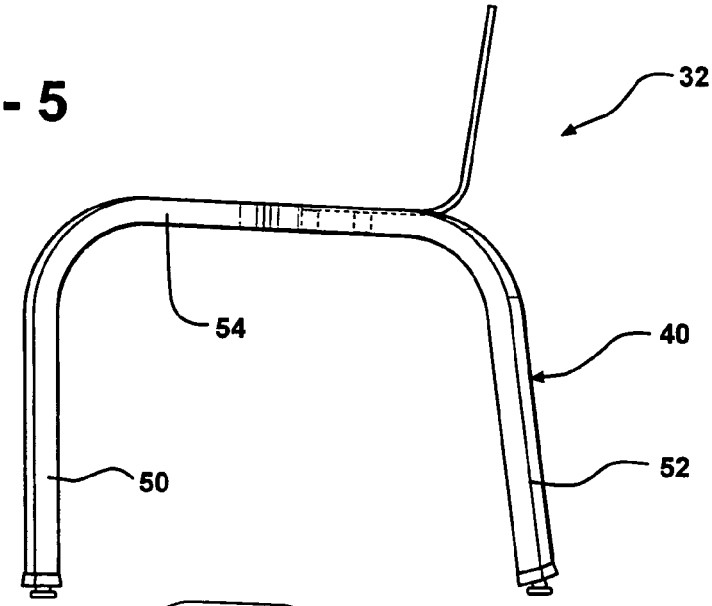
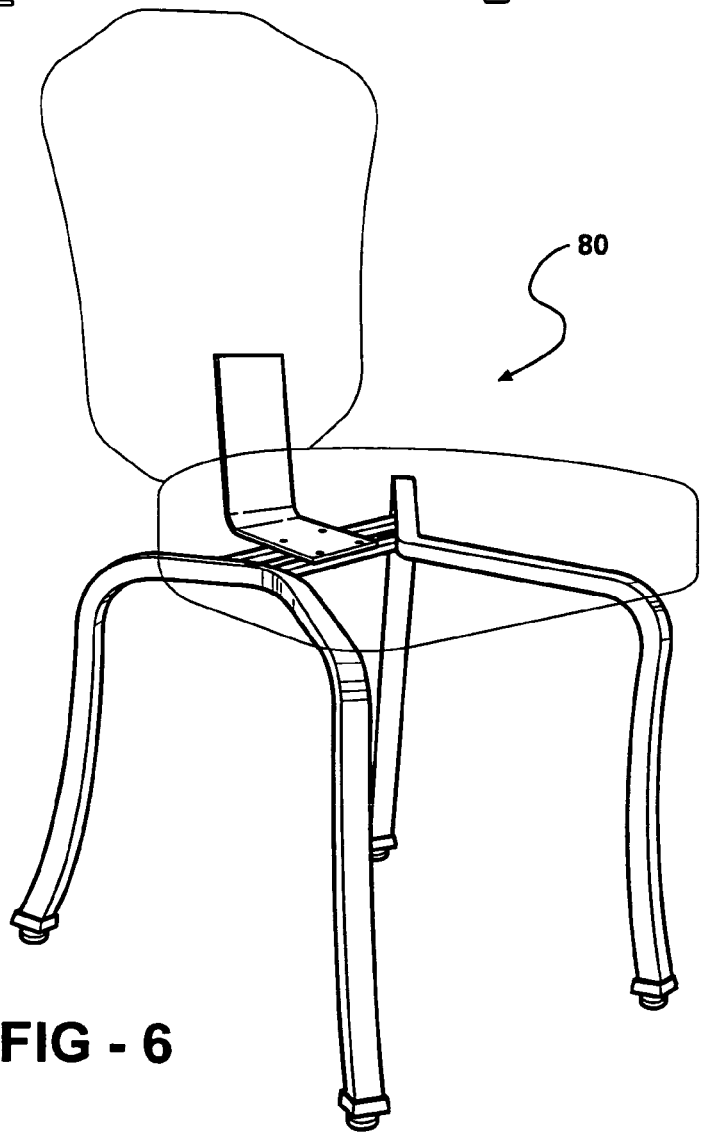
FIG - 6

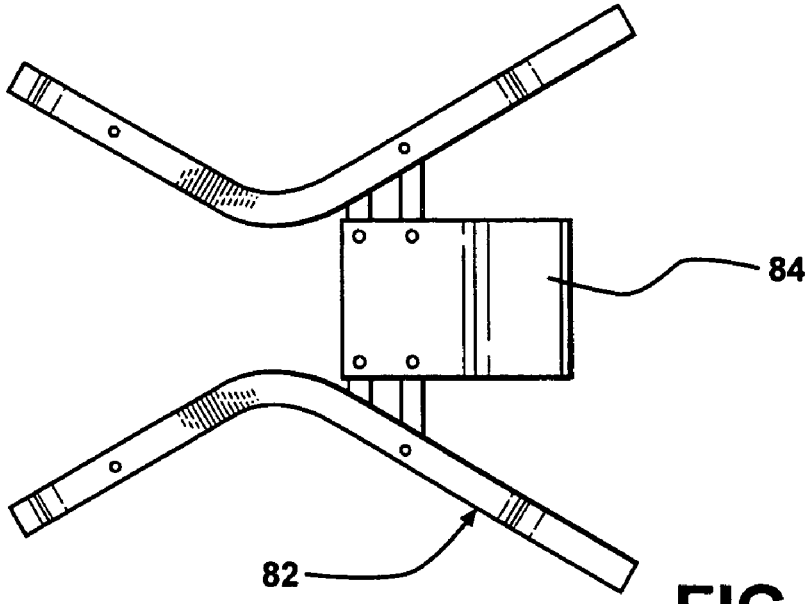
FIG - 7
FIG - 8
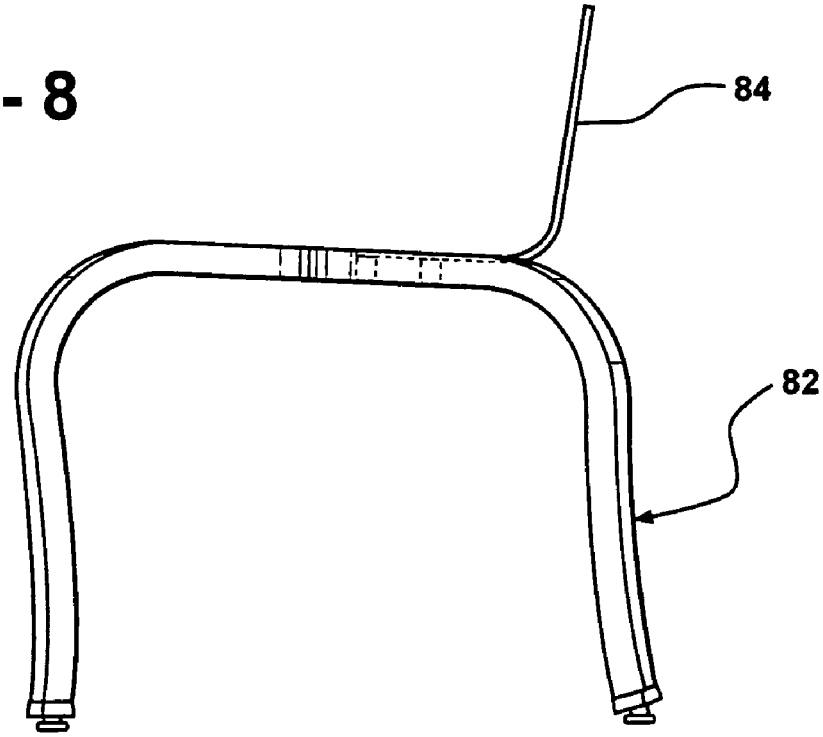

NESTING CHAIR WITH FLEXIBLE BACK

FIELD OF THE INVENTION

The present invention relates generally to chairs and, more specifically, to an improved nestable chair with a flexible back.

BACKGROUND OF THE INVENTION

Chairs for extended seating applications, such as banquet halls and conference rooms, are preferably comfortable, durable, and either stackable or nestable for storage purposes. Traditional stackable banquet chairs include a pair of inverted-U-shaped leg members attached to opposite sides of a generally horizontal seat. A generally L-shaped back support frame interconnects with the leg members and extends upwardly from the rear of the seat to support a back cushion. This type of chair may be stacked by placing the inverted-U-shaped leg members of one chair over the top of the leg members of another chair, such that the seat of the upper chair is supported just above the seat of the lower chair. Examples of traditional stackable banquet chairs are shown in U.S. Pat. No. 3,102,733 to Burnett and U.S. Design Pat. No. D180,996 to Cramer. While this type of chair has wide applicability, some property owners and interior designers prefer chairs that do not look like a traditional stacking chair. These traditional stacking chairs have the leg members completely exposed at the sides of the chairs. Some users prefer legs or leg members that are less visible.

The above-described chair is generally referred to as a stacking chair, because the leg members of one chair rest directly on the leg members of a lower chair creating a secure leg-on-leg stack. Multiple chairs may be securely stacked on top one another with this design.

An alternative to stacking chairs is so-called nesting chairs. Nesting chairs come in a variety of styles and are distinguished from stacking chairs in that the underside of a seat frame of one chair rests atop the seat cushion of a lower chair when the chairs are nested. An example of a nesting chair, as defined herein, is illustrated in U.S. Pat. No. 5,524,963 to Barile. An advantage with nesting chair designs is that the chair designer may configure the chair legs to be less exposed than with traditional stacking chairs.

Because chairs for extended seating applications are often used for extended periods of time, seating designers are continuously seeking ways to improve the comfort of the chairs. It is preferred that the seat back flex somewhat with respect to the seat cushion to improve comfort. However, providing a flexible seat back presents significant challenges to seat designers, especially where the chair must also stack or nest. Examples of stacking or nesting chairs with seat backs that flex relative to the seat bottom are shown in the following U.S. Pat. No. 4,549,764 to Haedo; U.S. Pat. Nos. 4,603,904, 4,869,552, and 5,039,163 to Tolleson; U.S. Pat. No. 4,938,532 to Burgess; and U.S. Pat. No. 5,902,012 to Han. The designs disclosed in these patents are generally complicated and costly to manufacture, limiting their applicability. Also, the designs are generally limited to stacking chairs wherein the legs of the chairs are completely exposed.

Another nesting chair design with a flexible back is shown in FIGS. 1 and 2. In these figures, the seat cushion and seat back are shown in phantom, to make the construction details of the chair more easily visible. This chair 10 includes a seat cushion 12 supported by symmetrical left and right leg members 14 and 16. While not shown, the seat cushion 12 includes a cushion base, which is typically a piece of flat wood. The leg members 14 and 16 are screwed or bolted directly to this seat cushion base so as to interconnect the cushion with the leg members and to maintain the relationship between the leg members. A generally L-shaped seat back bracket 18 has a lower end interconnected with the same seat cushion base and an upper end that extends up and interconnects with the seat back 20. Bracket 18 is preferably flexible enough that the seat back 20 can flex somewhat with respect to the seat cushion 12.

As will be clear to those of skill in the art, the seat cushion 12 takes a large amount of load in order to rigidly interconnect the various portions of the chair. That is, all forces transmitted between the seat back 20, seat cushion 12 and leg members 14 and 16 are carried by the seat cushion itself. This loading can be substantial, especially when a chair is dropped, a heavy occupant sits in the chair, or the occupant tilts the seat backwardly to lift the front leg members off the floor, or otherwise abuses the chair. This design also has the shortcoming that if an owner wishes to reupholster the seat cushion 12, the chair 10 must be completely disassembled. In other words, the leg members 14 and 16 do not form a self-supporting base.

SUMMARY OF THE INVENTION

The present invention improves on the prior art by providing a nesting chair with a flexible back and improved base design. The base for a chair according to the present invention is self-supporting and directly supports the seat back bracket, thereby reducing the loads transmitted through the seat cushion. According to a preferred embodiment of the present invention, a nesting chair includes a self-supporting seat base with a first leg member and a second leg member. Each of the leg members includes a front leg portion, a rear leg portion, and a generally horizontal portion. The leg portions each have lower floor contacting ends and opposite upper ends. The generally horizontal portions extend between and interconnect the upper ends of the leg portions. The base further includes at least one transverse member extending between and interconnecting the generally horizontal portion of the first leg member and the generally horizontal portion of the second leg member. Together, the first and second leg members and the at least one transverse member form a self-supporting base. A seat cushion is supported in a generally horizontal position by the chair base. The seat cushion has a front edge, a rear edge, and a pair of opposing side edges. A generally L-shaped back support bracket has a first generally horizontal end connected to the at least one transverse member of the base, and second generally vertical end extending upwardly adjacent the rear edge of the seat cushion. A seat back is connected to the second end of the back support bracket and extends upwardly therefrom.

BRIEF DESCRIPTION OF THE DRAWINGS

FIG. 5 is a side elevational view of the base of FIG. 4;

FIG. 6 is a perspective view of a second embodiment of a chair according to the present invention;

FIG. 7 is a top view of the base of the chair of FIG. 6; and FIG. 8 is a side elevational view of the base of FIG. 7.

DETAILED DESCRIPTION OF THE PREFERRED EMBODIMENTS

Figure 1:
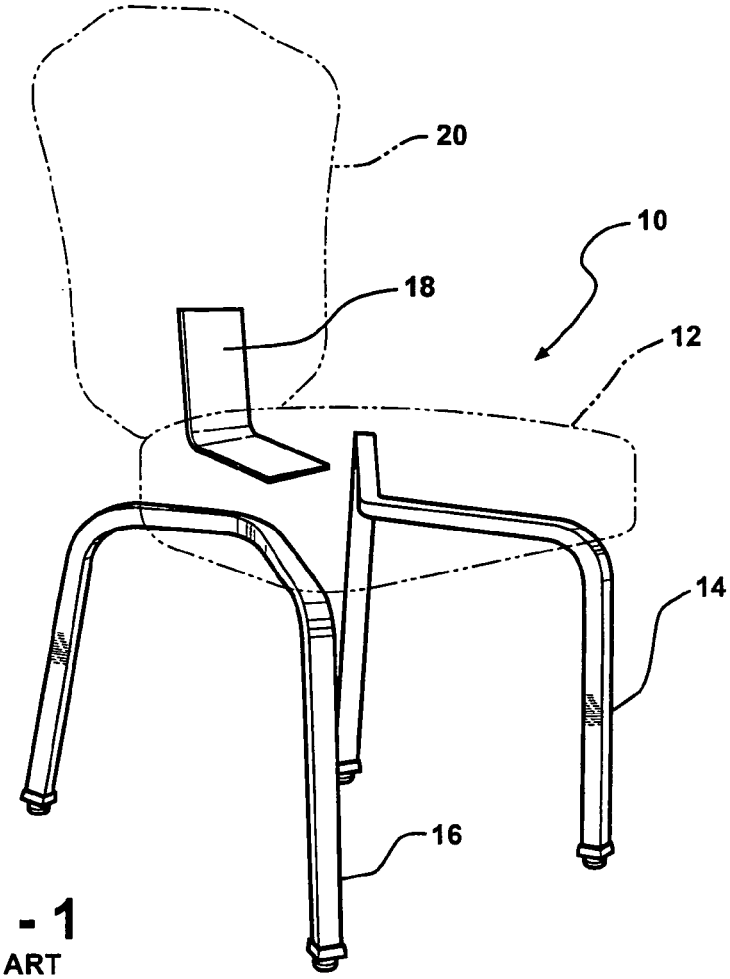
FIG - 1 PRIOR ART
FIG. 1 provides a perspective view of a prior art nesting chair, with the seat cushion and seat back shown in phantom line.
Figure 2:
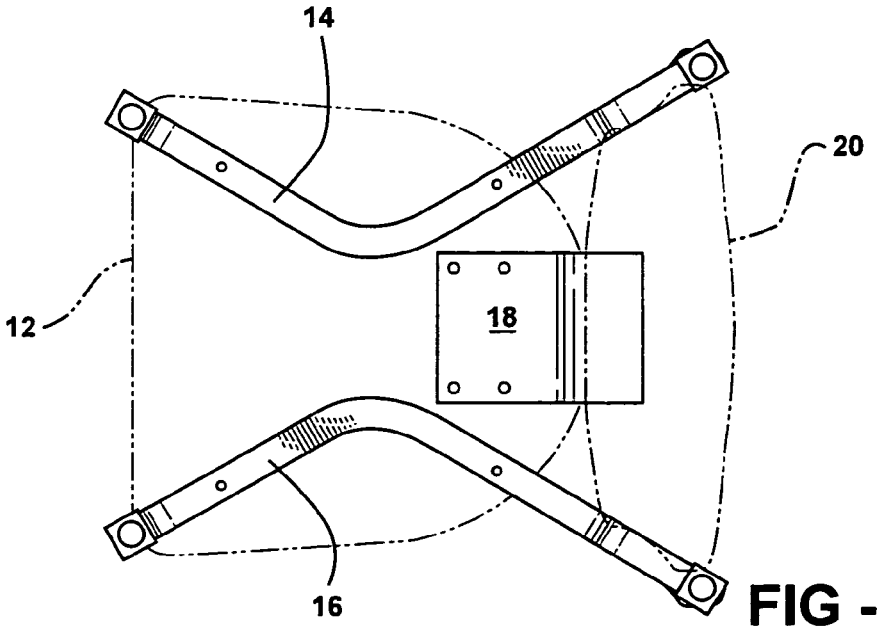
FIG - 2 PRIOR ART
FIG. 2 is a bottom view of the chair of FIG. 1.
Figure 3:
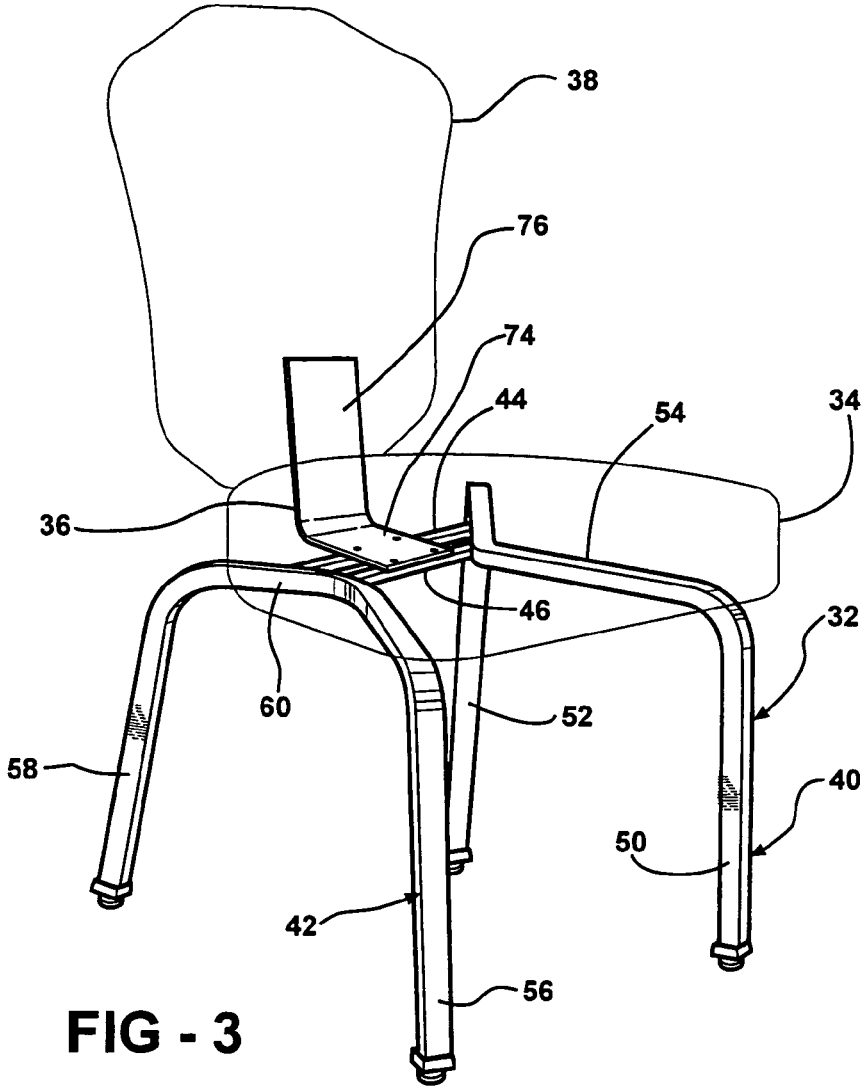
FIG. 3 is a perspective view of a first embodiment of a chair according to the present invention.

FIG. 3 shows a chair 30 according to a first embodiment of the present invention. The chair includes a self-supporting base 32 that supports a cushion 34 in a generally horizontal position. A seat back support bracket 36 is also interconnected with the self-supporting base 32, with the bracket 36 supporting a seat back 38 in a generally vertical position extending upwardly adjacent to the rear of the cushion 34. It is preferred that the support bracket 36 be sufficiently flexible such that the seat back 38 flexes rearwardly with respect to the cushion 34 when it is leaned against by a person.

Figure 4:
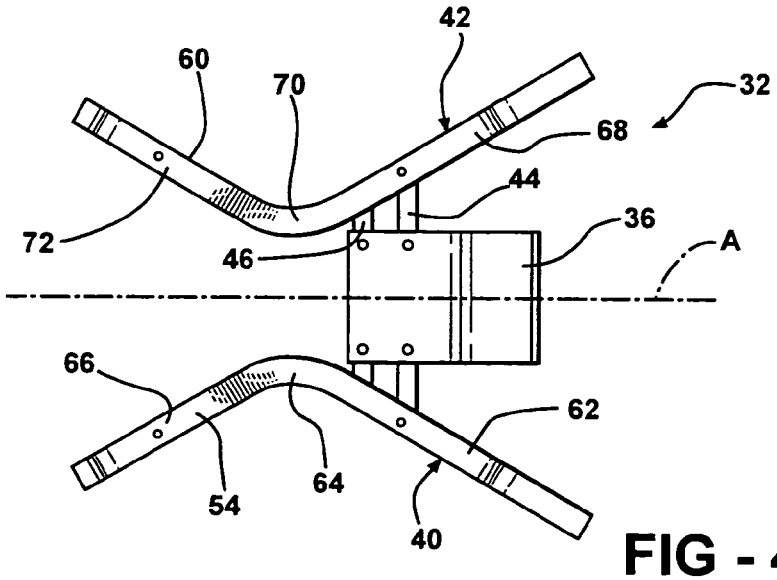
FIG. 4 is a top view of a base and seat back bracket for the chair of FIG. 3.

The self-supporting base 32 includes a first leg member 40 and a second leg member 42. Details of the self-supporting base 32 may also be seen in FIGS. 4 and 5. As shown, the leg members 40, 42 are symmetrical and are symmetrically arranged on opposite sides of a central plane, which is shown at A in FIG. 4.

A pair of transverse members 44, 46 extend between and interconnect the leg members 40, 42. Together, the leg members 40, 42 and the transverse members 44, 46 form a self-supporting base. That is, the base does not rely on the seat cushion to interconnect various portions of the base.

As best shown in FIGS. 3 and 5, the first leg member 40 may be said to have a front leg portion 50, a rear leg portion 52, and a horizontal portion 54. The leg portions 50, 52 may be said to have lower floor contacting ends and opposite upper ends. The generally horizontal portion 54 extends between and interconnects the upper ends of the leg portions. As shown, the leg member 40 is formed from a continuous piece of tubing which is bent into a generally inverted U-shaped member. The second leg member 42 is symmetrical with the first leg member, and may also be said to have a front leg portion 56, a rear leg portion 58, and a generally horizontal portion 60. The second leg member 42 is also formed from a continuous piece of a tubing. The horizontal portions 54, 60 do not extend in a straight line between the upper ends of the leg portions. Instead, they bend inwardly towards one another. This causes each of the leg portions to be angled outwardly somewhat from the center of the chair, and also for most of the horizontal portions 54, 60 to be hidden under the seat cushion 34. The shape of the horizontal portions 54, 56 may be best seen in FIG. 4. The horizontal portion 54 may be said to have a rear section 62, a central region 64, and a front section 66. Likewise, the horizontal portion 60 of the second leg member 42 may be said to have a rear section 68, a central region 70, and a front section 72. The central regions 64, 72 are the part of the leg members 40, 42 that are closest to the central plane A. The front sections 66, 72 and rear sections 62, 68 angle outwardly away from the central plane A. As shown, the transverse members 44, 46 interconnect the rear sections 62, 68 of the horizontal portions 54, 60, with the forwardmost transverse member 46 being adjacent the central regions 64, 70.

The seat cushion 34 may be said to define a generally horizontal plane, even though the cushion may be tilted rearwardly slightly. As shown, the base 32 is entirely disposed below the plane defined by the seat cushion 34.

The generally L-shaped back support bracket 36 has a first generally horizontal end 74 and a second generally vertical end 76. The first end 74 is connected to the transverse members 44, 46. Preferably, the first end 74 is connected to both of the members, using bolts or screws. This provides a very strong interconnection between the bracket 36 and the base 32 without relying on the cushion to transmit the force. By connecting the seat brackets 36 to both of the members 44, 46 the attachment and bending loading are also spread out. The seat back 38 connects with the second end 76 of bracket 36.

As will be clear to those of skill in the art, the cushion 34 may be removed from the remainder of the chair 30 without disassembling the base 32 or detaching of the bracket 36. In addition, because the base 32 takes the loads between the leg members 40, 42 and between the bracket 36 and the base 32, the cushion 34 can be made with less structure. For example, a base board that may form part of the cushion, not shown, may have a cut out central portion with flexible webbing spanning the opening. This provides a more flexible cushion, and thereby more comfort. Also, a shaped seat cushion baseboard may be used. Also, the transverse members 44, 46 are preferably positioned such that they are forward of the rear edge of the cushion 34, thereby hiding them from view.

Referring now to FIG. 6, an alternative embodiment of a chair 80 is shown. A base 82 and seat bracket 84 for the chair 80 are shown in FIGS. 7 and 8. This embodiment of the present invention differs from the first embodiment only in that the leg members have a somewhat different shape. As shown, the front and rear leg portions are curved slightly, rather than the generally straight shape in the first embodiment.

As will be clear to those of skill in the art, the embodiments of the present invention described herein may be altered in various ways without departing from the scope or teaching of the present invention. It is the following claims, including all equivalents, which define the scope of the present invention.

What is claimed is:

1. A nesting chair comprising:

a self supporting seat base comprising:

a first leg member including a front leg portion, a rear leg portion, and a generally horizontal portion, the leg portions having lower floor contacting ends and opposite upper ends, the generally horizontal portion extending between and interconnecting the upper ends of the leg portions, a second leg member spaced from the first leg member, the second leg member including a front leg portion, a rear leg portion, and a generally horizontal portion, the leg portions having lower floor contacting ends and opposite upper ends, the generally horizontal portion extending between and interconnecting the upper ends of the leg portions, each of the horizontal portions having a midpoint with a rear section defined rearward of the midpoint; and at least one transverse member extending between and interconnecting the rear section of the generally horizontal portion of the first leg member and the rear section of the generally horizontal portion of the second leg member, the at least one transverse member providing fore and aft spaced apart attachment points;

wherein the first and second leg members and the at least one transverse member together form a self supporting base;

a seat cushion supported in a generally horizontal position by the seat base, the seat cushion having a front edge, a rear edge, and a pair of opposing side edges;

a generally L-shaped back support bracket having a first generally horizontal end non-rotatably connected solely to and supported by the fore and aft attachment points of the at least one transverse member of the base and a second generally vertical end extending upwardly adjacent the rear edge of the seat cushion; and a seat back connected to the second end of the back support bracket and extending upwardly therefrom.

2. The nesting chair according to claim 1, wherein the at least one transverse member comprises a pair of transverse members, the first end of the back support bracket being connected to both of the transverse members.

3. The nesting chair according to claim 2, wherein the pair of transverse members are generally parallel to each other.

4. The nesting chair according to claim 1, wherein the horizontal portions of each of the leg members are bent inwardly toward each other such that a midportion of each horizontal portion is inboard of the side edges of the seat cushion.

5. The nesting chair according to claim 1, wherein the at least one transverse member is disposed forward of the rear edge of the seat cushion.

6. The nesting chair according to claim 1, wherein the leg members are symmetrically arranged on opposite sides of a central plane, the horizontal portions of the leg members each including a rear section, a central region, and a front section, the central regions being closest to the central plane with the front and rear sections angling outwardly away from the central plane.

7. The nesting chair according to claim 1, wherein the seat cushion has an underside that defines a generally horizontal plane, the seat base being entirely disposed below the horizontal plane.

8. A nesting chair comprising:

a self supporting seat base comprising:

a first leg member formed from a first continuous piece of tubing and including a front leg portion, a rear leg portion, and a generally horizontal portion, the leg portions having lower floor contacting ends and opposite upper ends, the generally horizontal portion extending between and interconnecting the upper ends of the leg portions, a second leg member spaced from the first leg member, the second leg member formed from a second continuous piece of tubing and including a front leg portion, a rear leg portion, and a generally horizontal portion, the leg portions having lower floor contacting ends and opposite upper ends, the generally horizontal portion extending between and interconnecting the upper ends of the leg portions, each of the horizontal portions having a midpoint with a rear section defined rearward of the midpoint; and at least one transverse member extending between and interconnecting the rear section of the generally horizontal portion of the first leg member and the rear section of the generally horizontal portion of the second leg member, the at least one transverse member providing fore and aft spaced apart attachment points;

wherein the first and second leg members and the at least one transverse member together form a self supporting base;

a seat cushion supported in a generally horizontal position by the chair base, the seat cushion having a front edge, a rear edge, and a pair of opposing side edges;

a generally L-shaped back support bracket having a first generally horizontal end non-rotatably connected solely to and supported by the fore and aft attachment points of the at least one transverse member of the base and a second generally vertical end extending upwardly adjacent the rear edge of the seat cushion; and a seat back connected to the second end of the back support bracket and extending upwardly therefrom.

9. The nesting chair according to claim 8, wherein the at least one transverse member comprises a pair of transverse members, the first end of the back support bracket being connected to both of the transverse members.

10. The nesting chair according to claim 9, wherein the pair of transverse members are generally parallel to each other.

11. The nesting chair according to claim 8, wherein the horizontal portions of each of the leg members are bent inwardly toward each other such that a midportion of each horizontal portion is inboard of the side edges of the seat cushion.

12. The nesting chair according to claim 8, wherein the at least one transverse member is disposed forward of the rear edge of the seat cushion.

13. The nesting chair according to claim 8, wherein the back support bracket is sufficiently flexible such that the seat back may flex with respect to the seat cushion when leaned on.

14. The nesting chair according to claim 8, wherein the leg members are symmetrically arranged on opposite sides of a central plane, the horizontal portions of the leg members each including a rear section, a central region, and a front section, the central regions being closest to the central plane with the front and rear sections angling outwardly away from the central plane.

15. The nesting chair according to claim 8, wherein the seat cushion has an underside that defines a generally horizontal plane, the seat base being entirely disposed below the horizontal plane.

16. A nesting chair comprising:

a self supporting seat base comprising:

a first leg member including a front leg portion, a rear leg portion, and a generally horizontal portion, the leg portions having lower floor contacting ends and opposite upper ends, the generally horizontal portion extending between and interconnecting the upper ends of the leg portions, a second leg member spaced from the first leg member, the second leg member including a front leg portion, a rear leg portion, and a generally horizontal portion, the leg portions having lower floor contacting ends and opposite upper ends, the generally horizontal portion extending between and interconnecting the upper ends of the leg portions, each of the horizontal portions having a midpoint with a rear section defined rearward of the midpoint; and at least one transverse member extending between and interconnecting the rear section of the generally horizontal portion of the first leg member and the rear section of the generally horizontal portion of the second leg member, the at least one transverse member providing fore and aft spaced apart attachment points;

wherein the first and second leg members and the at least one transverse member together form a self supporting base;

a seat cushion supported in a generally horizontal position by the seat base, the seat cushion having a front edge, a rear edge, and a pair of opposing side edges;

a generally L-shaped back support bracket having a first generally horizontal end non-rotatably connected solely to and supported by the fore and aft attachment points of the at least one transverse member of the base and a second generally vertical end extending upwardly adjacent the rear edge of the seat cushion; and a seat back connected to the second end of the back support bracket and extending upwardly therefrom;

wherein the back support bracket is sufficiently flexible such that the seat back may flex with respect to the seat cushion when leaned on.

17. A nesting chair comprising:

a self supporting seat base comprising:

a first leg member including a front leg portion, a rear leg portion, and a generally horizontal portion, the leg portions having lower floor contacting ends and opposite upper ends, the generally horizontal portion extending between and interconnecting the upper ends of the leg portions, a second leg member spaced from the first leg member, the second leg member including a front leg portion, a rear leg portion, and a generally horizontal portion, the leg portions having lower floor contacting ends and opposite upper ends, the generally horizontal portion extending between and interconnecting the upper ends of the leg portions, each of the horizontal portions having a midpoint with a rear section defined rearward of the midpoint; and at least one transverse member extending between and interconnecting the rear section of the generally horizontal portion of the first leg member and the rear section of the generally horizontal portion of the second leg member, the at least one transverse member providing fore and aft spaced apart attachment points;

wherein the first and second leg members and the at least one transverse member together form a self supporting base;

a seat cushion supported in a generally horizontal position by the seat base, the seat cushion having a front edge, a rear edge, and a pair of opposing side edges;

wherein the horizontal portions of each of the leg members are bent inwardly toward each other such that a midportion of each horizontal portion is inboard of the side edges of the seat cushion;

a generally L-shaped back support bracket having a first generally horizontal end connected solely to and supported by the fore and aft attachment points of the at least one transverse member of the base and a second generally vertical end extending upwardly adjacent the rear edge of the seat cushion; and a seat back connected to the second end of the back support bracket and extending upwardly therefrom.

18. The nesting chair according to claim 17, wherein the at least one transverse member comprises a pair of transverse members, the first end of the back support bracket being connected to both of the transverse members.

19. The nesting chair according to claim 18, wherein the pair of transverse members are generally parallel to each other.

20. The nesting chair according to claim 17, wherein the at least one transverse member is disposed forward of the rear edge of the seat cushion.

21. The nesting chair according to claim 17, wherein the back support bracket is sufficiently flexible such that the seat back may flex with respect to the seat cushion when leaned on.

22. The nesting chair according to claim 17, wherein the first leg member of the base is unitarily formed from a first continuous piece of tubing and the second leg member is unitarily formed from the second continuous piece of tubing.

23. The nesting chair according to claim 17, wherein the leg members are symmetrically arranged on opposite sides of a central plane, the horizontal portions of the leg members each including a rear section, a central region, and a front section, the central regions being closest to the central plane with the front and rear sections angling outwardly away from the central plane.

24. A nesting chair comprising:

a self supporting seat base comprising:

a first leg member including a front leg portion, a rear leg portion, and a generally horizontal portion, the leg portions having lower floor contacting ends and opposite upper ends, the generally horizontal portion extending between and interconnecting the upper ends of the leg portions, a second leg member spaced from the first leg member, the second leg member including a front leg portion, a rear leg portion, and a generally horizontal portion, the leg portions having lower floor contacting ends and opposite upper ends, the generally horizontal portion extending between and interconnecting the upper ends of the leg portions, and each of the horizontal portions having a midpoint with a rear section defined rearward of the midpoint; and at least one transverse member extending between and interconnecting the rear section of the generally horizontal portion of the first leg member and the rear section of the generally horizontal portion of the second leg member, the at least one transverse member providing fore and aft spaced apart attachment points;

wherein the first and second leg members and the at least one transverse member together form a self supporting base;

a seat cushion supported in a generally horizontal position by the seat base, the seat cushion having a front edge, a rear edge, and a pair of opposing side edges, the seat cushion having an underside that defines a generally horizontal plane, the seat base being entirely disposed below the horizontal plane;

a generally L-shaped back support bracket having a first generally horizontal end connected solely to and supported by the fore and aft attachment points of the at least one transverse member of the base and a second generally vertical end extending upwardly adjacent the rear edge of the seat cushion; and a seat back connected to the second end of the back support bracket and extending upwardly therefrom.

25. The nesting chair according to claim 24, wherein the at least one transverse member comprises a pair of transverse members, the first end of the back support bracket being connected to both of the transverse members.

26. The nesting chair according to claim 25, wherein the pair of transverse members are generally parallel to each other.

27. The nesting chair according to claim 24, wherein the at least one transverse member is disposed forward of the rear edge of the seat cushion.

28. The nesting chair according to claim 24, wherein the back support bracket is sufficiently flexible such that the seat back may flex with respect to the seat cushion when leaned on.

29. The nesting according to claim 24, wherein the leg members are symmetrically arranged on opposite sides of a central plane, the horizontal portions of the leg members each including a rear section, a central region, and a front section, the central regions being closest to the central plane with the front and rear sections angling outwardly away from the central plane.

* * * * *

UNITED STATES PATENT AND TRADEMARK OFFICE

CERTIFICATE OF CORRECTION

PATENT NO. : 7,014,268 B2
APPLICATION NO. : 10/702418
DATED : March 21, 2006
INVENTOR(S) : David Socha, Jr., et al.

It is certified that error appears in the above-identified patent and that said Letters Patent is hereby corrected as shown below:

Column 8, line 59 - Replace “nesting according” with --nesting chair according--.

Signed and Sealed this

Twenty-ninth Day of August, 2006

JON W. DUDAS
*Director of the United States Patent and Trademark Office*